US005944334A

United States Patent [19]

Zhao

[11] Patent Number: 5,944,334

[45] Date of Patent: Aug. 31, 1999

[54] DEVICE FOR MOVING OVER SNOW

[75] Inventor: Zhen Zhao, Creteil, France

[73] Assignee: Skis Rossignol S.A., France

[21] Appl. No.: 08/890,397

[22] Filed: Jul. 9, 1997

[30] Foreign Application Priority Data

Jul. 11, 1996 [FR] France ..... 96 08897

[51] Int. Cl.[6] ..... A63C 5/00; A63C 5/02; A63C 5/025; A43B 5/04

[52] U.S. Cl. ..... 280/600; 280/603; 280/604; 36/122

[58] Field of Search ..... 280/600, 601, 280/603, 11.12, 604, 7.1; 36/122, 123, 100

[56] References Cited

U.S. PATENT DOCUMENTS

| | | | |
|---|---|---|---|
| 2,410,702 | 8/1946 | Arsenault | 36/100 |
| 4,334,369 | 6/1982 | Brunel | 36/124 |
| 5,722,188 | 3/1998 | Ewing | 36/122 |

FOREIGN PATENT DOCUMENTS

| | | | |
|---|---|---|---|
| 2606660 | 5/1988 | France | 36/100 |
| 94225 | 7/1959 | Norway | 280/600 |
| 37183 | 8/1906 | Switzerland | 36/122 |

*Primary Examiner*—J. J. Swann
*Assistant Examiner*—Andrew J. Ririe
*Attorney, Agent, or Firm*—Wall Marjama Bilinski & Burr

[57] ABSTRACT

A device for moving over snow includes a bearing surface intended to come into contact with snow in the walking position and to distribute the pressure corresponding to a user's weight. The device includes a short gliding ski having a gliding surface adjacent the bearing surface and angled thereto and allow's fastening of the user's boot selectively to the bearing surface and the gliding ski.

12 Claims, 6 Drawing Sheets

FIG 1
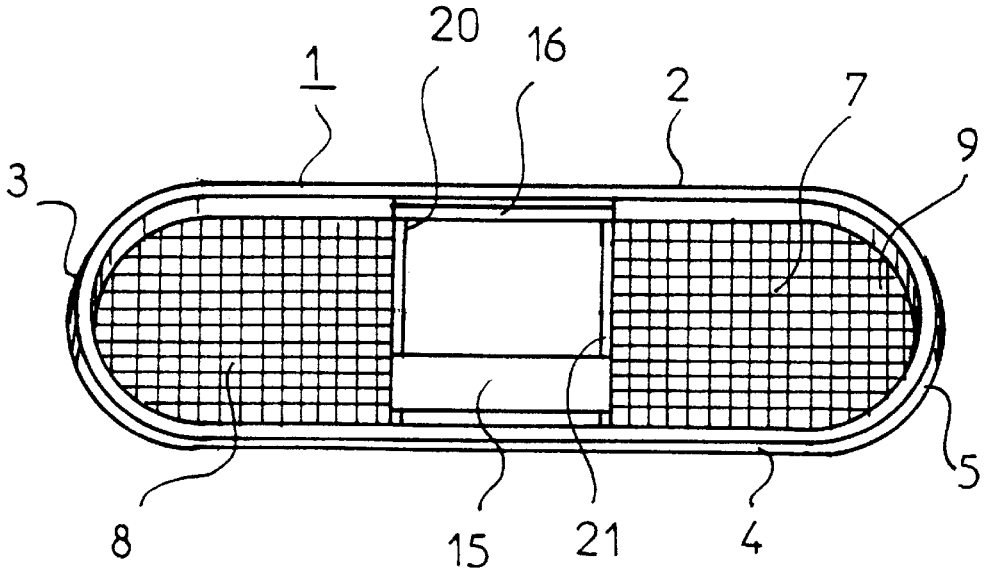
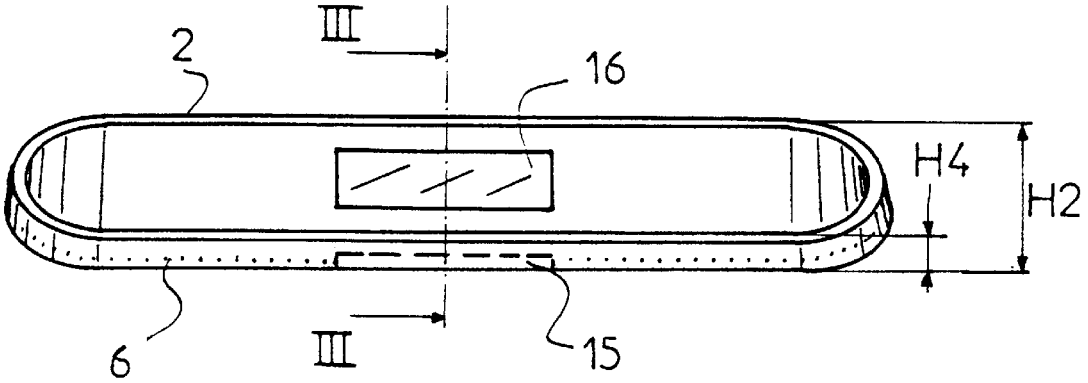
FIG 2

DEVICE FOR MOVING OVER SNOW

FIELD OF THE INVENTION

The invention relates to the field of winter sports, and more precisely to that of devices for moving over snow, in particular snowshoes for hiking. It relates more particularly to a snowshoe architecture which makes it possible to engage in a versatile form of hiking.

BACKGROUND OF THE INVENTION

There are currently many forms of snowshoes intended for hiking over snow. In general, a snowshoe has a bearing surface whose area is very much greater than that of the sole of a boot, this being in order to gain a wide purchase on the snow and distribute the pressure corresponding to the user's weight, and thus to prevent him from sinking into the snow.

At the same time, this bearing surface has means for fastening the user's boot. A number of alternative embodiments of this type of snowshoe are known. A wide variety of different forms have thus been proposed. It has been proposed to make this bearing surface openworked in order to save weight. It has also been proposed to allow the boot to be articulated to the bearing surface in order to make walking less difficult.

Using snowshoes of this type, the user progresses by walking over snow-covered surfaces, either uphill, on the flat or downhill.

In other words, a traditional snowshoe is intended for progressing step by step over snow while preventing any sliding. A downhill slope is therefore fairly difficult to negotiate because of the momentum due to the skier's mass, which might cause him to topple forward.

Documents U.S. Pat. No. 2,410,702 have proposed to equip a ski with two folding side wings constituting partial snowshoes.

More precisely, on each of its sides, the ski has a set of hinges which allow the two side wings to pivot in order to move them from a position in which they are parallel to the surface of the ski, corresponding to walking in snowshoe configuration, to a position in which they are raised to the side, in order to use just the ski function.

However, this device has several drawbacks, namely, on the one hand, that hinges are difficult to use from the point of view of reliability under the wet and icy conditions which are encountered when hiking over snow.

On the other hand, when the device is in a gliding configuration, the raised position of the wings, and in particular of the inner wings which face one another from one foot to the other, pose a problem of encumbrance and hinder the user's progress.

The problem which the invention proposes to solve is therefore to make it easier for the snowshoe to progress in downhill regions, using a device which is simple, ergonomic and mechanically robust.

SUMMARY OF THE INVENTION

The invention therefore relates to a device for moving over snow, of the type including a bearing surface which is intended to bear on the snow and to distribute the pressure corresponding to the user's weight, means for fastening the user's boot to the device, as well as a region which constitutes a short gliding ski.

The device according to the invention is one wherein the gliding surface of said short ski is adjacent to the bearing surface and forms an angle with said bearing surface.

In order words, the invention consists in giving the snowshoe a specific shape which allows it to fulfill both the function of support for walking on the flat and uphill, and the function of gliding downhill. The change from one configuration to the other is made by pivoting the snowshoe in accordance with an angle of 60 to 120° formed between the two working surfaces. The device is monobloc and undergoes no changes in configuration to change from one function to the other.

In a first practical embodiment, the bearing surface is bounded by a frame, one of the edges of which constitutes the short gliding ski. In other words, the characteristic frame fulfills both the function of a support for the bearing surface and of a gliding runner.

The snowshoe is therefore used to walk or glide depending on the orientation which the snowshoe is given.

If a closed frame is used, it has been observed that the snowshoe was most ergonomic when the gliding surface makes an angle of 90° to 110° with the bearing surface.

In other words, by virtue of this angulation, when the gliding runner is laid flat on the snow, the opposite part of the frame is offset transversely and bears on the inside of the user's lower leg, which allows the short ski to be guided better, in particular when setting the edges.

With the same purpose, the opposite side of the frame from the short gliding ski may advantageously have a height which is much less than that of the runner. In this way, when the snowshoe is in the gliding position, the frame is offset from the vertical of the gliding runner.

In one practical embodiment, the frame has a rectangular general shape in which the front and rear ends corresponding to the short sides of the rectangle are curved. In this way, one of the long sides of the rectangle serves as a short gliding ski and the curved ends fulfill the role of raised ends for said runner. This achieves a good compromise between the length of the short gliding ski and the area of the bearing surface of the snowshoe.

In order to attach the boot, in one embodiment, the frame has two struts joining two opposite sides of the frame while serving as a support for the means for fastening the boot to the bearing surface. For example, the struts may be transverse and join the side that forms the short gliding ski to the opposite side.

In an alternative embodiment, the side forming the short gliding ski also has a means for fastening the boot to the short gliding ski.

Advantageously, the means for fastening the boot to the bearing surface can pivot relative to the short gliding ski in order to serve as a means for fastening the boot to the gliding runner.

In another embodiment, the bearing surface is formed by two frames, respectively front and rear, joined by a connecting element serving as the gliding runner. In other words, in this illustrative case, the bearing surface is divided into two separate regions. It is then advantageous for these two frames to be connected by the gliding runner itself.

In an alternative embodiment, the bearing surface is formed by a rigid framework consisting of a main bar and transverse branches, and of a lightweight structure fastened to the main bar and to the transverse branches of the rigid framework.

BRIEF DESCRIPTION OF THE DRAWINGS

The way in which the embodiment may be embodied, and the advantages which result therefrom, will emerge clearly from the following description of embodiments, supported by the appended figures, in which:

FIG. 1 is a plan view of a device according to a first embodiment of the invention.

FIG. 2 is a side view of said device.

DETAILED DESCRIPTION OF THE INVENTION

Figure 3:
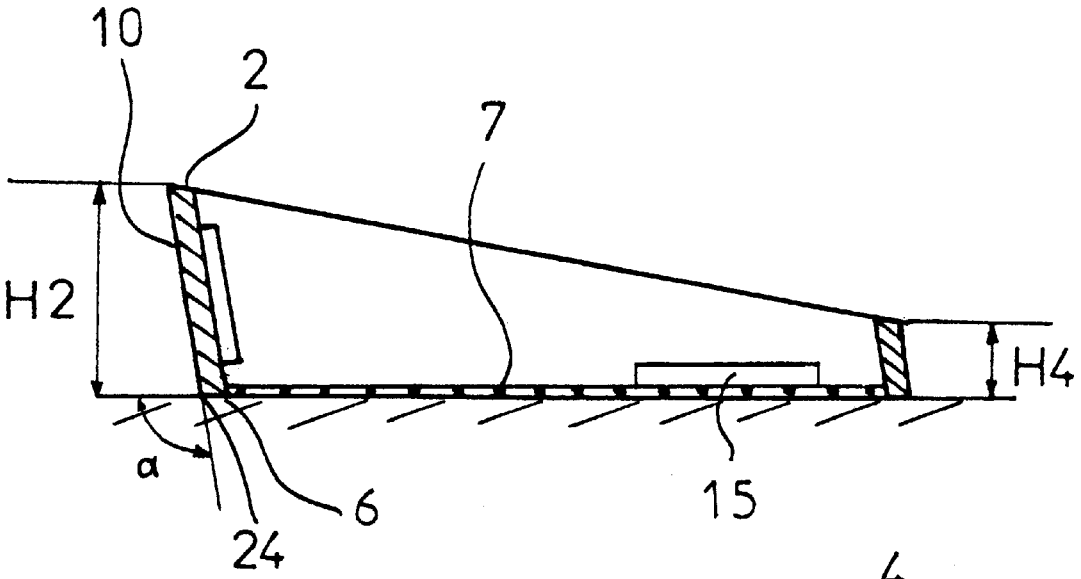
FIG. 3 is a median cross section along the arrows III—III in FIG. 2, shown in the walking position.
Figure 4:
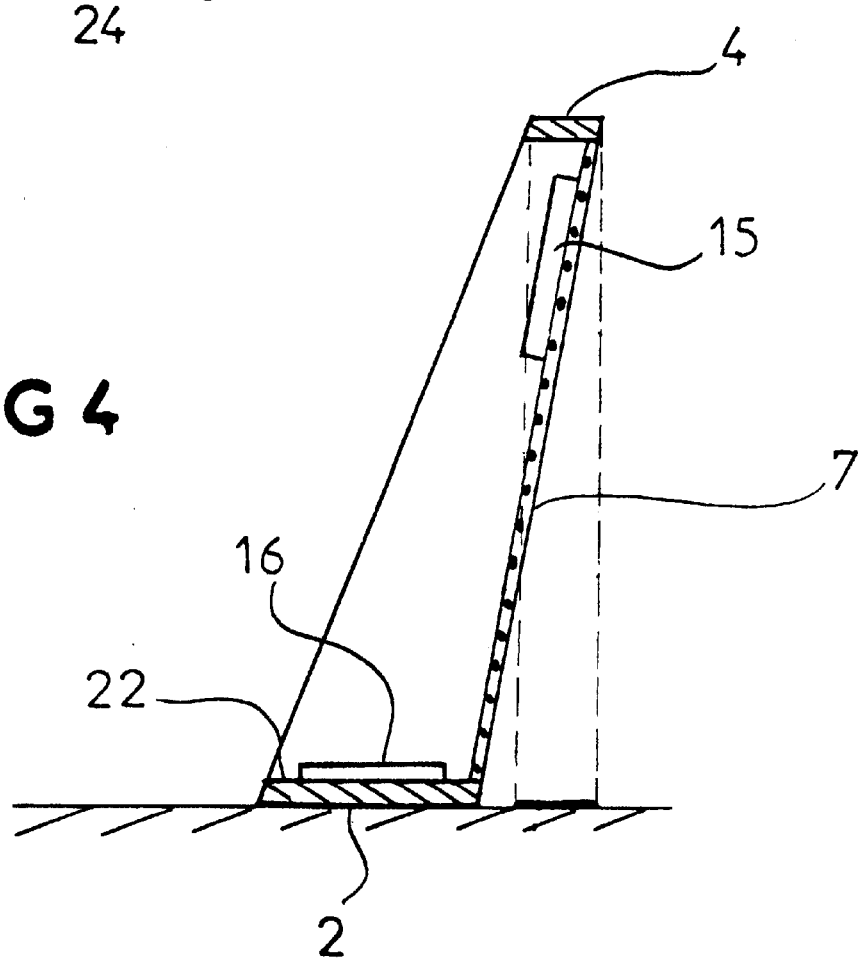
FIG. 4 is an identical section of the snowshoe of FIGS. 1–3, shown in the gliding position.

The snowshoe according to the invention has a bearing surface which is intended for walking and is secured to a gliding runner which, in the manner of a ski, makes it possible to glide over a downhill slope.

Quite clearly, there are many architectures which make it possible to adhere to the spirit of the invention, and this invention is not limited to the illustrative embodiments which follow.

Thus, in a first embodiment, the snowshoe consists of a frame (1) of elongate general shape.

More precisely, this frame (1) has two parallel sides (2, 4) joined by the front and rear ends (3, 5) forming circle arcs.

The lower face (6) of this frame (1) is planar, except at the ends (3, 5), and accommodates the bearing surface (7) of the snowshoe. This bearing surface (7) may be formed in a variety of ways, for example by an attached solid panel, or advantageously by one or more openworked panels, without this effecting the spirit of the invention.

Thus, in the embodiment represented, this bearing surface (7) is subdivided into two portions (8, 9), respectively located in the front and rear parts of the snowshoe.

According to one essential feature of the invention, one of the sides (2) of the frame (1) constitutes the gliding runner which makes it possible to progress, in the manner of a ski, over a downhill slope.

Thus, this side (2) has an outer face (10) FIG. 3 designed to have a low coefficient of friction. It may, for example, be a sole made of a material used to make skis, optionally bordered by metal ridges (not shown).

As can be seen in FIGS. 2 and 3, the height (H2) of the side (2) forming the gliding runner is much greater than the height (H4) of the opposite side (4).

In addition, as illustrated in FIG. 3, the outer face or sole (10) of the gliding runner (2) forms a characteristic angle a with the bearing surface (7).

Typically, this angle $\alpha$ is between 60 and 120°, and preferably in the region of 100°.

Figure 8:
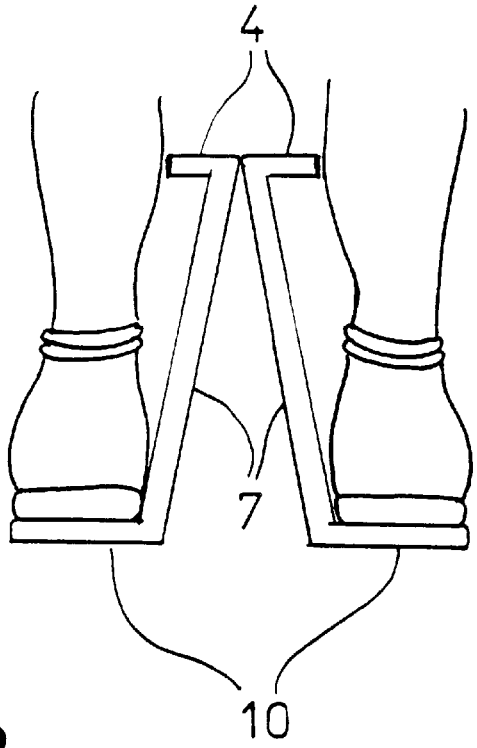

The combination of this angle $\alpha$ with the height difference (H2–H4) of the sides of the frame allows a clearance above the gliding runner which is needed in order to accommodate the user's foot fitted with the boot when the snowshoe is in the "sliding" position (FIG. 8).

It is also useful for the side (4) to bear on the boot or on the user's calf in order to allow more effective edge setting, and therefore better control of the gliding runner.

In the form represented in FIGS. 1 to 4, the frame (1) has two transverse struts joining the sides (2, 4). These struts (20, 21) reinforce the transverse rigidity of the snowshoe and accommodate a binding plate (15) for the user's boot. Quite clearly, these struts or cross pieces (20, 21) can be replaced by any equivalent means, in particular by a transversal or longitudinal panel (not shown).

According to one feature of the invention, the inner or upper face (22) of the gliding runner also accommodates a binding plate (16) for the ski boot.

The snowshoe according to the invention is used as follows.

Figure 5:
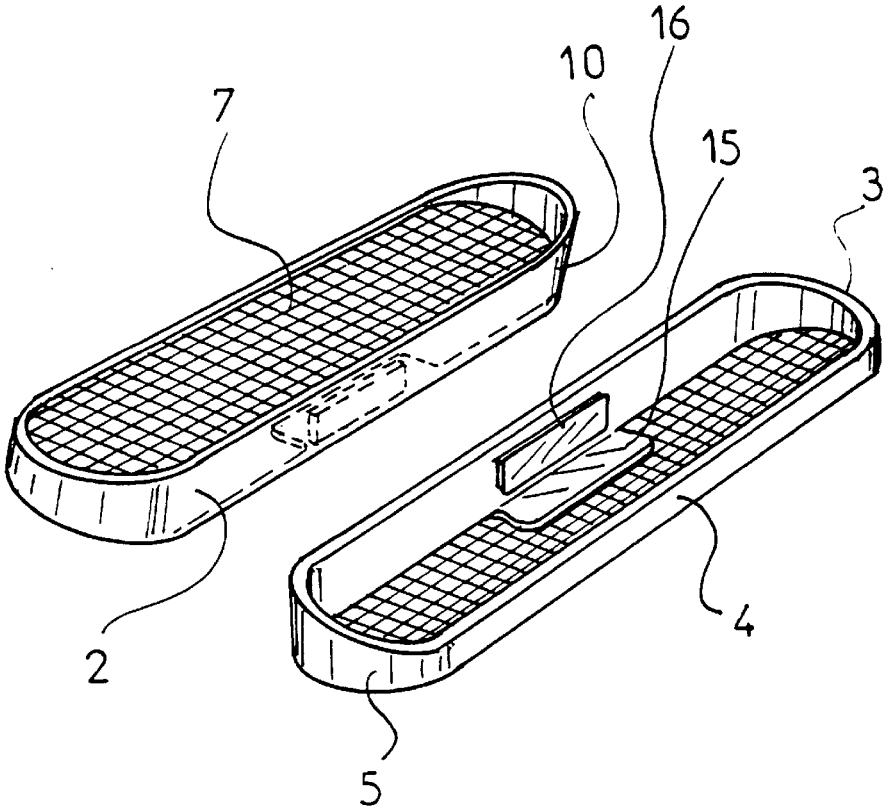
FIGS. 5 and 6 are outline perspective views of a pair of snowshoes according to the invention, shown with exaggerated spacing, respectively in the walking position and in the gliding position.
Figure 7:
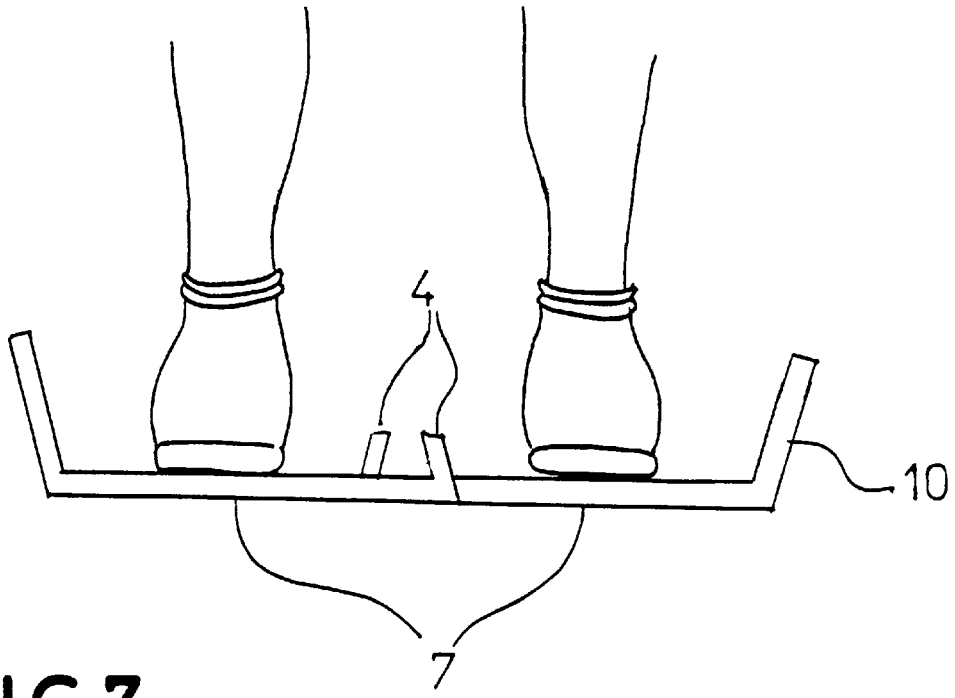
FIGS. 7 and 8 are schematic rear views of a pair of snowshoes when worn, respectively in the walking and gliding positions.

When the user desires to progress uphill or on the flat, he places the snowshoe flat, that is to say with the bearing surface (7) in contact with the snow, as illustrated in FIG. 5 or 7.

He then fastens his boots to the snowshoe and walks as he would with traditional snowshoes.

Figure 6:
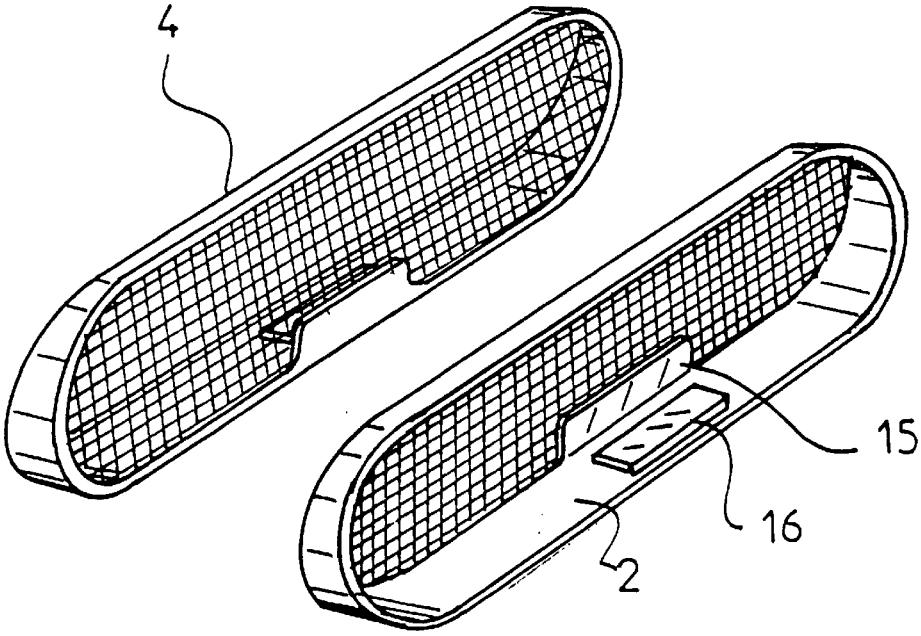

Thereafter, when he decides to arrange his snowshoes in the gliding position, he unfastens his snowshoes from his boots and pivots the snowshoes about the corner (24) to arrange them in accordance with FIG. 6 or 8.

He then needs just to fasten his boot to the second binding plate (16) in order to then progress over the gliding slope.

Depending on the geometry and degrees of symmetry of the snowshoes, and on the binding systems which are chosen, the user can, in the "walking" position, either arrange the gliding runners (10) on the outside of each of his legs (see FIG. 7), or on the inside (not shown), and likewise in the "gliding" position, he can arrange the bearing surface (7) either on the inside (see FIG. 8), or on the outside (not shown) of each of his legs.

Figure 9:
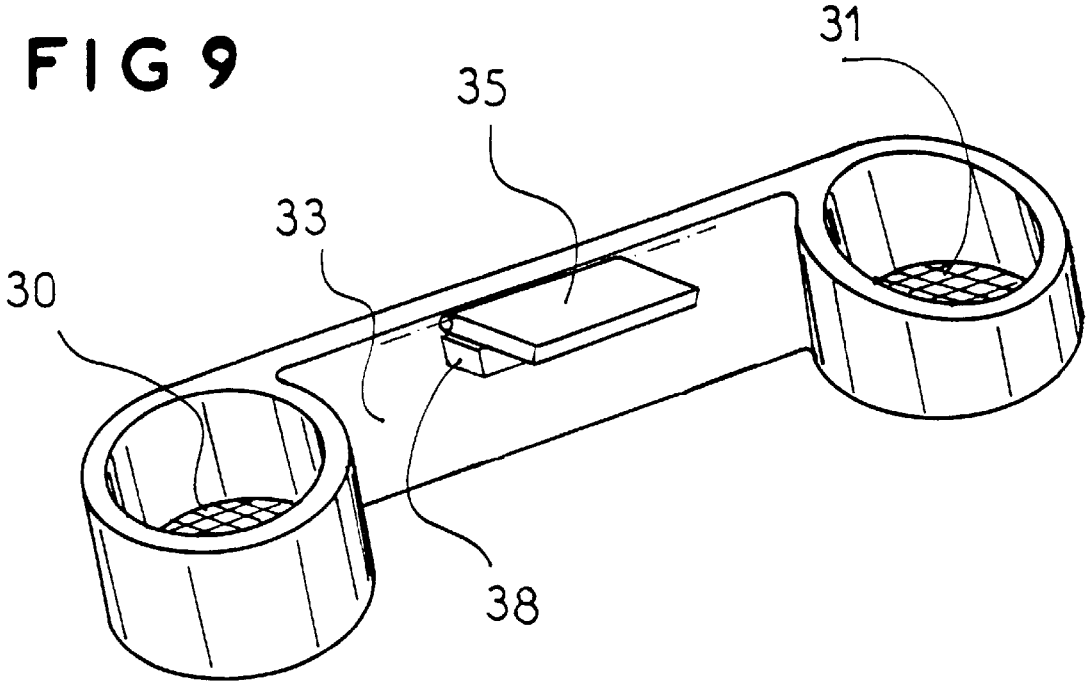
FIGS. 9 and 10 are outline perspective views of a snowshoe according to a second embodiment of the invention, shown respectively in the walking and gliding positions.
Figure 10:
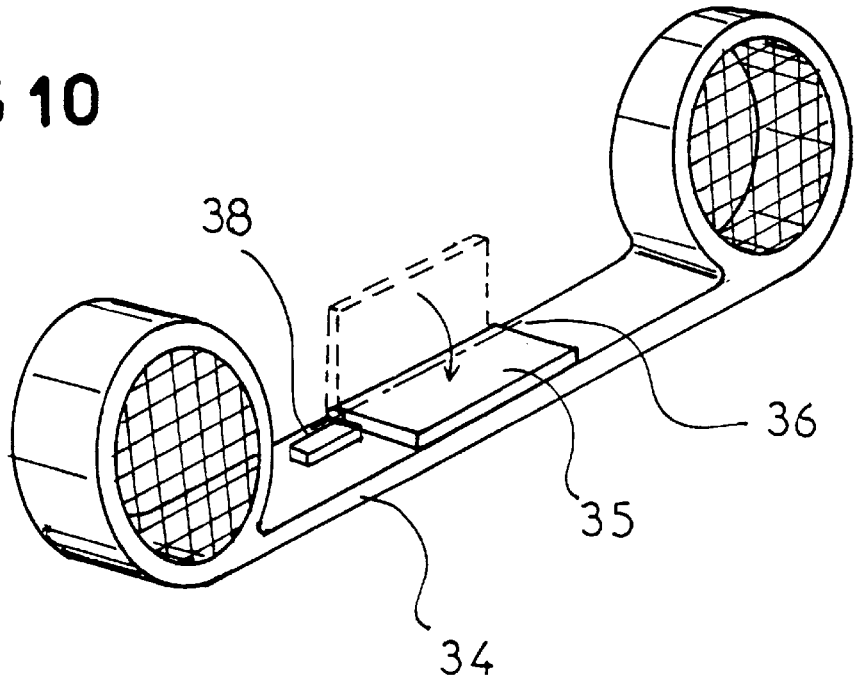

According to a second embodiment, illustrated in FIGS. 9 and 10, the bearing surface may be separated into two regions (30, 31), respectively front and rear, joined by the gliding runner (33). Quite clearly, these individual bearing surfaces (30, 31) are arranged coplanar and in alignment with the corner (34) of the gliding runner (33).

In this illustrative case, the gliding surface (30, 31) may be perpendicular to the gliding runner (33). The shape of the bearing surfaces (30, 31) can be optimized in such a way that the vertical to the gliding runner level with the binding (35) is cleared.

In the form which is represented, the binding support plate (35) is advantageously articulated to the runner (33) about a longitudinal axis (36) in order to allow the boot to be attached in both positions of the snowshoe using the same means. The binding support plate (35) may, for example, be locked in position by a retractable stop (38), sliding along the longitudinal axis of the short ski.

Figure 11:
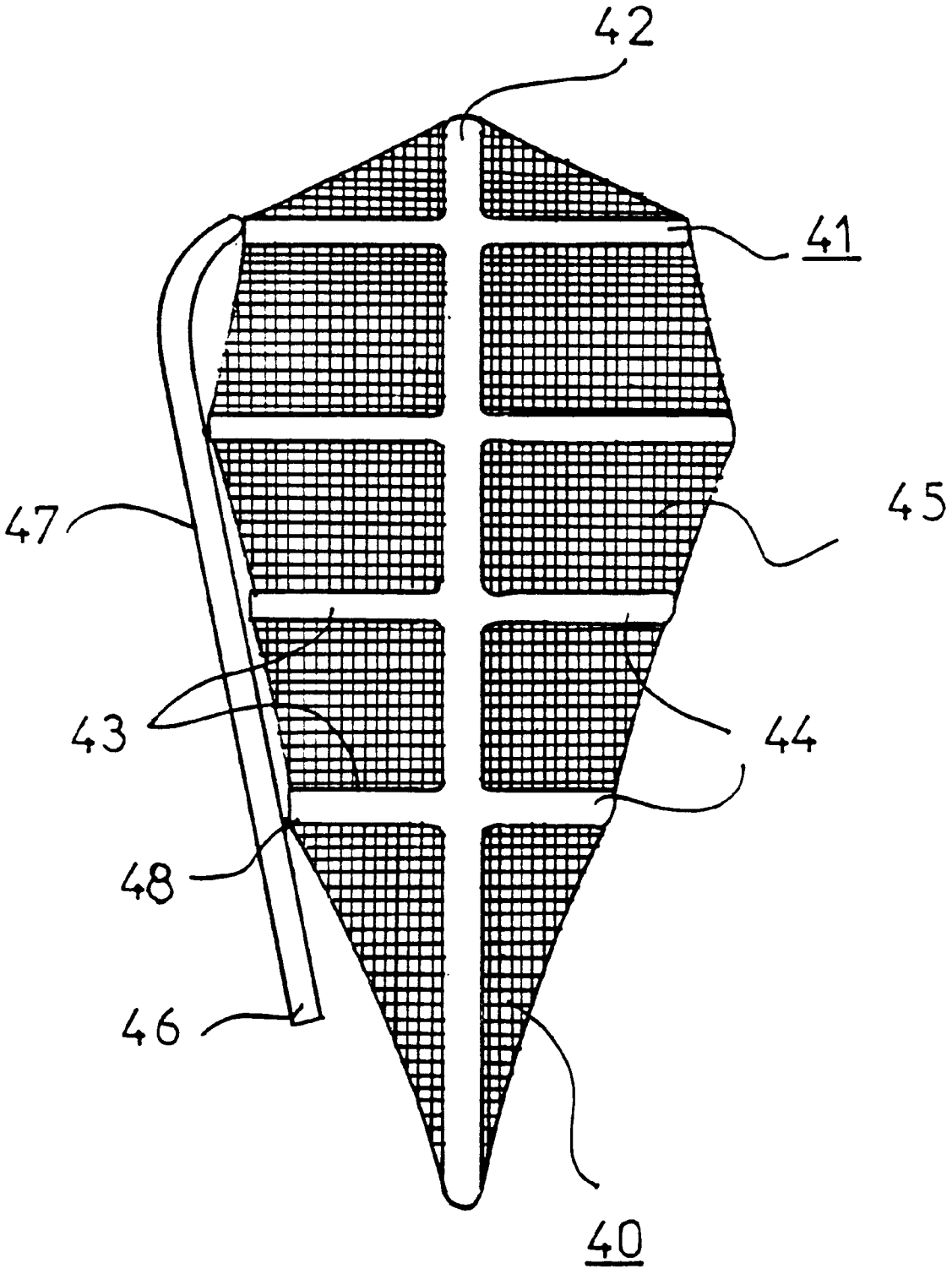
FIG. 11 is a plan view of another alternative embodiment.

In an alternative embodiment which is illustrated in FIG. 11, the bearing surface (40) consists of a ramificated rigid framework (41) having a central bar (42) and transverse branches (43, 44) over which a lightweight structure (45) is stretched. This lightweight structure may, as already mentioned, be produced in several ways, in particular by an openworked panel or a textile fabric, without affecting the spirit of the invention. In this case, the short ski (46) has its gliding surface (47) substantially perpendicular to the bearing surface. The short ski is joined to the bearing surface (40) of the ends (48) of some of the transverse branches (43).

The above description shows that the snowshoe according to the invention makes it possible both to walk on a flat or uphill snow field and to progress by gliding over a snow-covered slope.

The user can thus encounter new experiences hitherto unknown in snowshoe hiking, which make a wider variety of routes possible.

I claim:

1. A device for moving over snow selectively, as a snowshoe or a ski, said device comprising:

a bearing surface configured to be brought into contact with snow in a walking position, said bearing surface being capable of distributing the pressure corresponding to a user's weight, means for fastening a user's boot to said device, and a region constituting a short gliding ski, wherein said gliding ski includes a snow gliding surface, said surface forming an angle with said bearing surface, wherein the angle between said bearing surface and said gliding surface is fixed and is the same whether the short gliding ski or the bearing surface is utilized by a user.

2. A device according to claim 1, wherein the angle between said snow gliding surface and said bearing surface is between about 60 degrees and 120 degrees.

3. A device according to claim 2, wherein the angle between said snow gliding surface and said bearing surface is about 100 degrees.

4. A device according to claim 1, wherein the bearing surface is bounded by a frame and wherein the short gliding ski is constituted by one lateral side of said frame.

5. A device according to claim 4, wherein said frame has a transverse plane of symmetry.

6. A device according to claim 4, wherein a lateral side of said frame opposite to the side constituting the short gliding ski has a height which is significantly less than the height of the side constituting the short gliding ski.

7. A device according to claim 4, wherein said frame is defined by a generally rectangular shape including curved front and rear ends.

8. A device according to claim 4, wherein said frame includes at least transverse strut joining opposite lateral sides of said frame, said struts providing support for said boot fastening means.

9. A device according to claim 4, wherein the lateral side of said frame forming the short gliding ski includes second fastening means for fastening a user's boot to the short gliding ski.

10. A device according to claim 1, wherein said bearing surface is formed by a front frame and a rear frame, said front and rear frames being joined by a connecting element serving as a short gliding ski.

11. A device according to claim 1, wherein said bearing surface is defined by a rigid framework having a main bar and extending transverse branches, and a lightweight structure fastened to said main bar and said transverse branches.

12. A device according to claim 1, wherein said boot fastening means is pivotable relative to an extending axis to allow said boot fastening means to be located between said bearing surface and said short gliding ski to serve as a means for fastening a boot selectively to the short gliding ski and said bearing surface.

* * * * *